United States Patent [19]

Schoustra et al.

[11] 3,951,655

[45] Apr. 20, 1976

[54] DYE SENSITIZED PHOTOCONDUCTIVE MATERIAL

[75] Inventors: Bauke Schoustra, Tegelen; Hubertus W. H. M. Roncken, Helden, both of Netherlands

[73] Assignee: Oce-van der Grinten N.V., Venlo, Netherlands

[22] Filed: June 27, 1974

[21] Appl. No.: 483,567

[30] Foreign Application Priority Data

July 9, 1973 United Kingdom ..... 32554/73
Jan. 31, 1974 United Kingdom ..... 4496/74

[52] U.S. Cl. ..... 96/1.7; 96/1.6
[51] Int. Cl.[2] ..... G03G 5/09
[58] Field of Search ..... 96/1.6, 1.7, 1.5, 109; 252/501

[56] References Cited

UNITED STATES PATENTS

| | | | |
|---|---|---|---|
| 3,069,365 | 12/1962 | Shely | 96/1.7 |
| 3,122,435 | 2/1964 | Noe | 96/1.6 |
| 3,647,433 | 3/1972 | Contois | 96/1.6 |
| 3,723,116 | 3/1973 | Kinjo et al. | 96/1.6 |

*Primary Examiner*—David Klein
*Assistant Examiner*—John L. Goodrow
*Attorney, Agent, or Firm*—Albert C. Johnston

[57] ABSTRACT

Electrophotographic sheet material comprising a dye-sensitized photoconductive layer is made resistant to fading of its light-sensitivity by incorporating in the photoconductive layer a nitro-substituted xanthene dye, e.g. safrosin.

6 Claims, No Drawings

DYE SENSITIZED PHOTOCONDUCTIVE MATERIAL

This invention relates to dye sensitized photoconductive sheet material for use in electrophotography.

Various organic photoconductors and the white or nearly white inorganic photoconductors such as zinc oxide show the greatest sensitivity to radiation of a wavelength below 4200 A. It is already known that the spectral sensitivity of photoconductive materials can be extended to the complete visible spectrum by adding one or more organic dyes which are capable of absorbing radiant energy and transferring it to the photoconductor. Dye-sensitization of photoconductive materials is described, for example, in British Pat. Specification No. 811,165.

However, the light-sensitivity of the known dye sensitized photoconductive materials fades considerably if the photoconductive materials are subjected to the combined action of repeated charging, exposure, development and transferring in an indirect electrophotographic process.

It is believed that fading is at least partially caused by decomposition of the dye by ozone and/or atomic oxygen which are formed during charging and exposing the photoconductive material.

The electrophotographic sheet material according to the invention contains a photoconductive insulating layer sensitized by one or more nitro-substituted xanthene dyes represented by the following formula and mesomeric and tautomeric forms thereof:

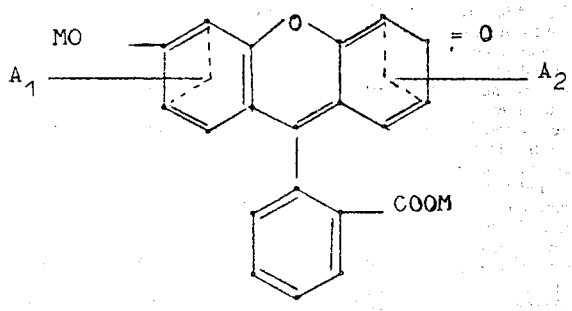

in which M represents a hydrogen or metal atom or a methyl or ethyl group and wherein $A_1$ or $A_2$ or both $A_1$ and $A_2$ represent nitro groups in an ortho position with respect to the -OM and/or keto group. The nitro-substituted xanthene dyes used in the sheet material according to the invention may contain additional substituents such as halogen atoms or lower alkyl, lower alkoxy, nitro, hydroxyl and/or esterified hydroxyl groups.

The electrophotographic sheet material according to the invention is much more stable to the action of processing conditions than a similar electrophotographic sheet material sensitized with a corresponding xanthene dye containing no nitro groups. In addition, photoconductive layers containing a mixture of one or more of the nitro substituted xanthene dyes defined above and one or more other sensitizing dyes also resist the processing conditions as far as fading of the light-sensitivity is concerned, even when the latter dyes are rather unstable. For example the light-sensitivity of a photoconductive layer based on zinc oxide, a binder and a mixture of saffrosine (CI Index. No. 45400) with methylene blue TGO (CI Index No. 52025), erythrosine (CI Index No. 45430) or Bromphenol Blue does not decrease as a result of repeated charging and exposure, although the light-sensitivity of a photoconductive layer containing methylene blue, erythrosine or Bromphenol Blue without a nitro xanthene dye decreases considerably under the same conditions. The addition of a Lewis acid such as hydro-chloric acid as an activator to increase the light-sensitivity of the photoconductive sheet material according to the invention does not adversely affect the stability.

The nitro xanthenes may be prepared by treating commercially available xanthene dyes with a mixture of concentrated nitric acid and concentrated sulphuric acid at a temperature of about 0°C. The dyes may also be prepared by substituting nitro groups for halogen atoms in commercially available dyes by heating a solution of a halogen substituted dye in ethanol with a 65 % solution of nitric acid at a temperature of about 75°C.

The photoconductive layer of the electrophotographic sheet material according to the invention may be composed of an organic photoconductor with or without a binder or an inorganic photoconductor such as finely divided zinc oxide or so-called pink zinc oxide dispersed in a binder such as a mixture of polyvinylacetate and a styrene-ethylacrylate copolymer. Other binders such as acrylic acid esters, methacrylic acid esters, chlorinated rubber, vinyl polymers such as polyvinyl chloride and polyvinyl acetate, cellulosic esters and ethers, alkyd resins, epoxy resins, silicone resins, photoconductive resins such as polyvinylcarbazole, and mixtures and copolymers of these products, may also be used.

The sensitizing dyes may be incorporated in the photoconductive layer in an amount of between 0.001 and 1 % by weight of the photoconductor. Usually concentrations between about 0.01 and 0.02 by weight of the photoconductor are preferred in zinc oxide-binder coatings for direct electrophotographic materials and concentrations between about 0.02 and 0.25 % are preferred in zinc oxide-binder coatings for indirect electrophotographic processes.

The photoconductive layer may be applied to any support which is common for photoconductive layers, for example, use may be made of metallic, plastic or paper supports which may be provided with an insulating or conductive layer to modify the electric properties. Said layer may be composed of metal, plastic or a conductive pigment such as carbon dispersed in a plastic binder. Examples of dyes suitable for use in the materials according to the invention are shown in Table I below.

TABLE I

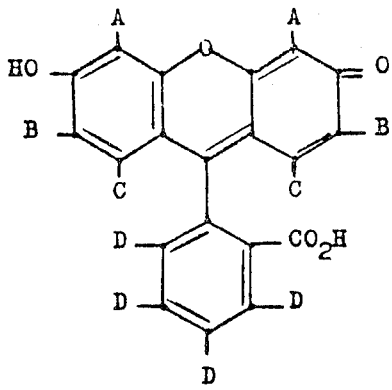

-continued

| | A | B | C | D |
|---|---|---|---|---|
| 1 | H | $NO_2$ | H | H |
| 2 | $NO_2$ | H | H | H |
| 3 | $NO_2$ | $NO_2$ | H | H |
| 4 | Br | $NO_2$ | H | H |
| 5 | $NO_2$ | Cl | H | H |
| 6 | I | $NO_2$ | H | H |
| 7 | $NO_2$ | H | H | Br |
| 8 | $NO_2$ | OH | H | H |
| 9 | $NO_2$ | Br | H | Cl |
| 10 | $NO_2$ | Br | H | Br |
| 11 | $NO_2$ | Br | H | H |

The practice of the invention is further illustrated by the following examples:

EXAMPLE I

A dispersion was prepared by mixing:

100 g of zinc oxide (Neige C of the firm Vieille Montagne), 17 g of a mixture of polyvinylacetate and a copolymer of ethylacrylate and styrene, 90 g of toluene, and 5 ml of a 4 % by weight solution of saffrosine in methanol.

The dispersion was coated on a conductive paper and dried. The dried coating weighed 28 g per $m^2$. An endless belt of the resulting sheet material was used in an indirect electrophotographic book copier and subjected to repeated charging, exposure, development and transferring. The light-sensitivity of the photoconductive material decreased to a lower extent than the light-sensitivity of a similar photoconductive material in which the nitro substituted dye was replaced by 4,5-dibromo fluorescein.

EXAMPLE II

A series of materials according to the invention was compared with materials sensitized with corresponding dyes containing no nitro groups by preparing a series of comparable photoconductive materials, each material being sensitized with one of the dyes mentioned in Table II below. Each of the photoconductive materials was prepared by mixing:

100 g of zinc oxide (Neige C of the firm Societe de Mines et Founderies de la Vieille Montagne S.A.), 26.6 g of a mixture of polyvinylacetate and a copolymer of ethylacrylate and styrene (E202 of the firm De Soto Chemical Company), 90 ml of toluene, and 1.2 ml of a 4 % by weight solution of sensitizing dye in methanol or dioxane (depending on the solubility of the dyes).

The resulting dispersion was coated on a conductive paper and dried.

The light-sensitivity of each photoconductive material was measured before and after contacting the materials for three hours with air containing ozone in a concentration of 8 p.p.m. The results are collected in Table II, which shows the light-sensitivities by the number of lux. sec needed to decrease the potential of the maximally charged photoconductive layer to 10 % of the maximum value. The numbers of the compounds in Table II correspond with the numbers in table I.

Table II

| | light-sensitivity | | change | reflection minimum | |
|---|---|---|---|---|---|
| | fresh | after ozone treatment | in % | wavelength in mm | reflection in % |
| Fluorescein | 30.5 | 42 | −40 | | |
| dinitrofluorescein (compound 2) | 61 | 56 | +10 | 496 | 51 |
| tetranitrofluorescein (compound 3) | 76 | 69 | +15 | 501 | 66 |
| 4,5-diiodo fluorescein | 14.5 | 20.5 | −40 | 524 | 52 |
| dinitro diiodo fluorescein (compound 6) | 46.5 | 43.0 | +5 | 512 | 51 |
| 4,5-dibromo fluorescein | 15 | 18.5 | −25 | 533 | 49 |
| saffrosine (compound 4) | 17 | 18.5 | −10 | 532 | 50 |
| 2′,7′-dibromo fluorescein | 22 | 31.5 | −45 | 503 | 59 |
| 2′,7′-dibromo dinitro fluorescein (compound 11) | 39.5 | 43 | −10 | 507 | 58 |
| hexabromo fluorescein | 28 | 39.5 | −40 | 532 | 67 |
| hexabromo dinitro fluorescein (compound 10) | 56 | 54 | +5 | 531 | 64 |
| dibromo tetrachloro fluorescein | 25 | 35 | −40 | 524 | 64 |
| dinitro dibromo tetrachloro fluorescein (compound 9) | 54 | 50 | +10 | 523 | 58 |

We claim:

1. Electrophotographic sheet material comprising a photoconductive insulating layer containing at least one sensitizing nitro-substituted xanthene dye selected from the group consisting of compounds represented by the following formula and mesomeric and tautomeric forms thereof:

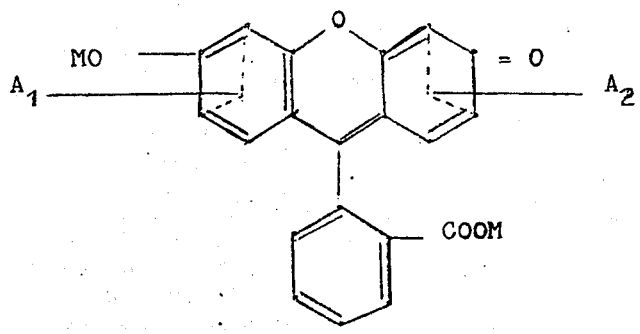

in which M represents a hydrogen or metal atom or a methyl or ethyl group and wherein $A_1$ or $A_2$ or each of $A_1$ and $A_2$ represents a nitro group in an ortho position with respect to the —OM and/or keto group, and each remaining position is unsubstituted or substituted by one or more substituents selected from the group consisting of halogen atoms and lower alkyl, lower alkoxy, nitro, hydroxyl and esterified hydroxyl groups.

2. Electrophotographic sheet material according to claim 1, said at least one dye comprising a nitro-substituted fluorescein.

3. Electrophotographic sheet material according to claim 1, said at least one dye comprising safrosin.

4. Electrophotographic sheet material according to claim 1, said layer containing a photoconductor and containing said at least one dye in an amount of between 0.001 and 1% of the weight of said photoconductor.

5. Electrophotographic sheet material according to claim 1, said layer comprising a photoconductive zinc oxide dispersed in an organic binder and containing said at least one dye in an amount of between 0.01 and 0.25% of the weight of said zinc oxide.

6. Electrophotographic sheet material according to claim 1, said layer comprising a photoconductive zinc oxide dispersed in an organic binder and being sensitized by a mixture of dyes comprising safrosin and methylene blue, erythosine or Bromphenol Blue.

* * * * *